United States Patent [19]

Brooks

[11] 3,999,416

[45] Dec. 28, 1976

[54] COLD ROLLING A CONTOUR IN METAL RINGS

[75] Inventor: Ralph Chesley Brooks, Georgetown, Mass.

[73] Assignee: General Electric Company, Lynn, Mass.

[22] Filed: Oct. 24, 1975

[21] Appl. No.: 625,461

[52] U.S. Cl. ..... 72/69; 72/105

[51] Int. Cl.[2] ..... B21H 1/06

[58] Field of Search ..... 72/69, 105, 106, 110

[56] References Cited

UNITED STATES PATENTS

| | | | |
|---|---|---|---|
| 2,925,003 | 2/1960 | McMullen et al. | 72/106 |
| 3,029,667 | 4/1962 | Sporck | 72/105 |
| 3,078,745 | 2/1963 | Erdelyi | 72/69 |
| 3,795,125 | 3/1974 | Laing et al. | 72/69 |

OTHER PUBLICATIONS

Metals Handbook, 8th Ed., vol. 5, Forging and Casting, American Society for Metals, pp. 108–109.

*Primary Examiner*—Lowell A. Larson
*Attorney, Agent, or Firm*—James W. Johnson, Jr.; Derek P. Lawrence

[57] ABSTRACT

A cold metal ring is greatly expanded in radial diameter and simultaneously contoured to a desired cross-sectional shape by successively rolling the ring between selected pairs of roll dies. If necessary, the ring may be annealed between successive cold rolling operations sufficiently to permit movement of ring material without fracturing the ring. Thereafter, the rolled ring may be expanded to a precise radial diameter utilizing a precision expander. Dimensional and contour control of the ring is comparable to that attainable by machining.

11 Claims, 8 Drawing Figures

COLD ROLLING A CONTOUR IN METAL RINGS

BACKGROUND OF THE INVENTION

This invention relates to a method of manufacture and in particular relates to a method of manufacturing metal rings of discrete cross-sectional shapes and precise radial diameters.

Metal rings are used throughout industry in a wide variety of applications. Such rings are particularly useful in the construction of parts for gas turbine engines including the construction of vane casings, fan casings, combustor liners, and turbine shrouds. Typically, metal ring structures for gas turbine engines have been constructed from metal ring blanks of rectangular cross-section having a radial diameter and axial width substantially equal to that of the final ring structure and having a cross-sectional thickness equal to or greater than the thickest part of the final ring structure. A lathe is used to cut away excess material from the starting blank in order to achieve a desired cross-sectional contour. Typically in such an operation as much as 90% of the original starting material may have to be removed in order to achieve the desired cross-sectional contour. Accordingly, such prior art machining methods have been found to be both extremely time-consuming and wasteful. This problem is particularly acute in the construction of rings for use in gas turbine engines because of the relatively expensive high temperature metal alloys used, and relatively high cost to machine these tough alloys.

Other processes have been used for manufacturing metal rings such as back extrusion, hot ring rolling and hot or cold rolling a contour on a strip stock and then making a ring therefrom. However, these prior art processes have rarely offered cost reductions over the process of making rectangular sections and machining. Such prior art processes have economic factors which have prevented them from being widely utilized for construction of gas turbine engine parts. Thus, the manufacturing costs for hot rolled ring configurations have been found to be sufficiently high as to make utilization of such processes limited. Further, hot rolling processes have also been found to lack sufficient manageability to be able to hold the close tolerances of size and shape required for gas turbine engine ring structures. Accordingly, in such hot rolling processes it has been necessary to subsequently machine the rolled structure on a lathe in order to obtain the required dimensional tolerances with a resultant undesirable increase in manufacturing time and material waste. Similarly, prior art methods for cold rolling ring structures have been heretofore unable to be utilized successfully for manufacturing metal rings suitable for use in gas turbine engines, without the need for subsequent costly machining.

SUMMARY OF THE INVENTION

It is therefore the primary object of the present invention to provide a process for the manufacture of metal rings of discrete cross-sectional shapes and precise radial diameters in which there is no wastage of starting material and which can be accomplished in significantly less time than prior art ring manufacturing techniques.

According to the method of the present invention, an initial ring of rectangular circular, or other desired cross-section and having a weight equal to the weight of a desired final ring structure is successively cold rolled between selected pairs of roll dies to a desired diameter and cross-sectional contour. The dies are designed such that each roll pass will cause simultaneous axial redistribution of the ring material and corresponding radial growth of the ring diameter. The ring may be annealed between successive roll operations as may be required to permit movement of ring material without fracture of the ring. Since the final ring diameter is usually critical, the ring may be rolled to a diameter which is slightly less, preferably within 0.5% of the desired final ring diameter and then expanded on a precision expander to the desired final diameter. The accuracy of such an expansion exceeds that usually attainable because of the uniformity and repeatability of cross-sectional contour and ring diameter of rings rolled in accordance with the teachings of this invention.

Because no material is lost in the manufacturing operation of this invention, material costs in the production of ring configurations is significantly less than similar costs for machined rings. Further, because no subsequent hot working or machining operation is required, it has been found that quantities of rings may be rolled utilizing the process of this invention in considerably less time than is required to manufacture similar quantities of rings utilizing prior art techniques. Further, because contouring is achieved in incremental steps utilizing a plurality of roll die sets and several revolutions for each set of roll dies, the separating load between roll dies is significantly less than is necessary for conventional rolling techniques. Accordingly, the machinery used to practice the method of this invention is less costly than that used in conventional rolling applications wherein relatively large separating loads must be tolerated.

BRIEF DESCRIPTION OF THE DRAWINGS

The invention may be better understood from reading the following description in conjunction with the drawings in which.

DESCRIPTION OF THE PREFERRED EMBODIMENT

Figure 1:
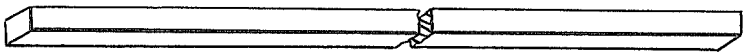
FIG. 1 is a perspective view of a piece of strip metal stock which may be utilized in the process of this invention.
Figure 2:
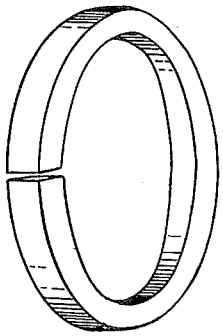
FIG. 2 is a perspective view of the metal stock of FIG. 1 formed in accordance with the teachings of this invention.
Figure 3:
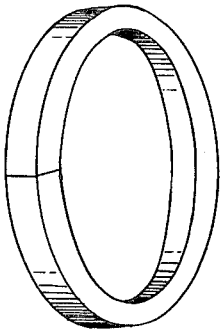
FIG. 3 is a perspective view of a ring blank which may be utilized in the method of this invention.

In performing the method of this invention, a suitable ring configuration such as shown in FIG. 3 is used as the starting material. The initial ring may be formed by rolling a strip or bar of metal stock as shown in FIG. 1 into a ring shape as shown in FIG. 2 and thereafter joining the ends to form a ring as illustrated in FIG. 3. Any suitable method known in the art which results in a relatively smooth and clean joint may be utilized to join the ends. Minor discontinuities at the joint can be removed in subsequent rolling operations. The starting ring configuration may be formed by other suitable processes such as by back extruding a metal billet to form a cylinder and thereafter slicing the cylinder into ring structures such as illustrated in FIG. 3. The weight of the initial ring must be carefully selected so as to be exactly equal to the weight of the desired final ring structure since no material is wasted in forming the final ring. The initial diameter of the starting ring should be considerably less (typically one-half) than that of the desired final ring structure. Utilization of a smaller diameter is necessary to allow for some diametral growth during early rolling cycles within which axial material distribution occurs. Once major axial material distribution is accomplished, rolling to final configuration is accomplished with quite uniform metal reduction throughout the ring with minor axial metal redistribution.

The initial ring is successively rolled between selected pairs of circular symmetrical dies made from a suitable metal alloy so as to contour the ring which is concurrently enlarged in radial diameter. It is preferred that the early dies be utilized to achieve predominant axial movement of material with a lesser increase in ring diameter, and that the dies which are utilized later in the process be designed to achieve the accurate configuration with lesser diametrical increase commensurate with the desired cross-sectional reduction percentage. This rolling sequence is important because too early an increase in the radial diameter of the rolled ring with a resultant decrease in material thickness may leave insufficient material thickness to achieve the desired cross-sectional contouring and result in too large a diameter. Further, in order to attain dimensional control in the final stages of rolling it is desirable to have essentially uniform reduction throughout the entire ring cross-section. Further, while it is preferred that all rolling operations be performed on cold ring structures, it is also possible to use known prior art hot rolling techniques in the early stages of rolling in order to more rapidly approximate the axial contour early in the rolling operation. When using such prior art hot rolling techniques for the early roll passes, it is desirable that the final roll passes be performed cold in order to maintain acceptable dimensional tolerance levels.

It is desirable to lubricate the dies between changes. In conventional rolling, it is not desirable to have too efficient a lubricant or too low a coefficient of friction or the rolled part will slip in the die. However, the bite taken by the die in the process of this invention is much less per pass than generally utilized in prior art processes. Accordingly, highly efficient lubricants such as grease and molybdenum disulphide can be used to aid in the axial distribution of ring material.

Figure 4:
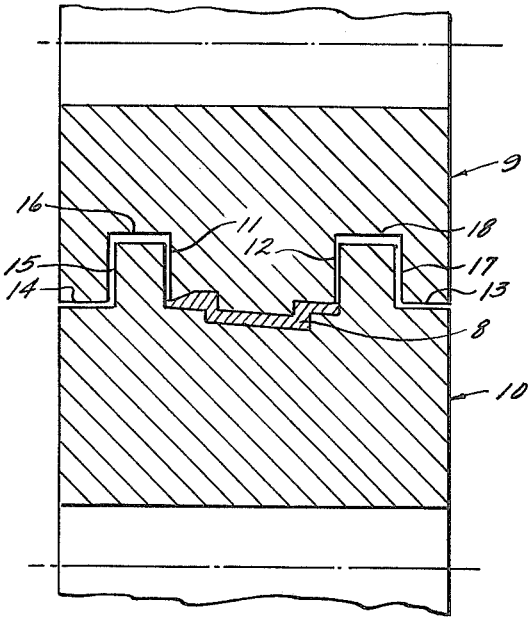
FIG. 4 is a cross-sectional view of a ring and die set used in the practice of this invention in a closed die position.
Figure 5:
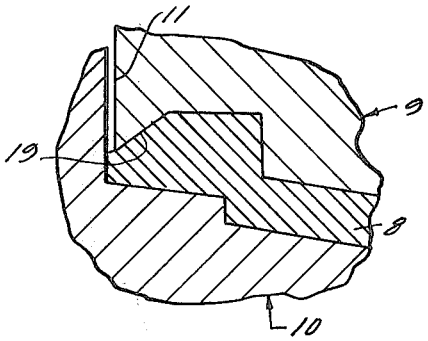
FIG. 5 is an exploded view of a portion of the ring and die set of FIG. 4.
Figure 9:
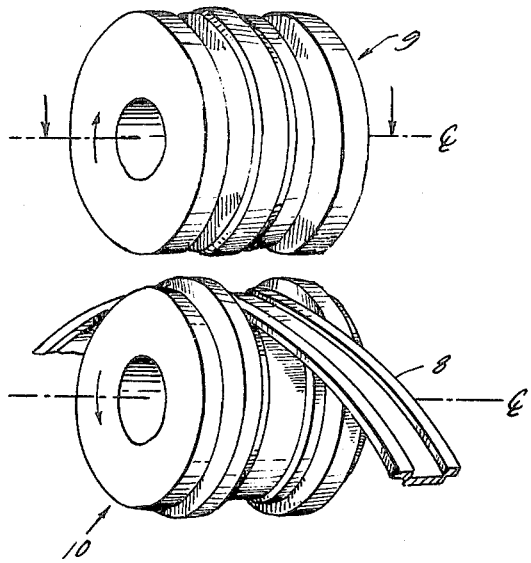
FIG. 9 is a perspective view of the ring and die set of FIG. 4 in an open die position.

The number of die sets required will depend upon the degree of contouring desired and the work hardening tendency of the material which is utilized. Each pair of rolled dies must be carefully selected so as to achieve the maximum amount of material movement without causing fracture of the ring. The roll dies for this process are based on an encapsulating concept as can best be seen in FIGS. 4, 5 and 9. Thus, the upper die 9 and lower die 10 completely encapsulate the cross-section of the rolled ring 8. The upper and lower dies are constructed with close tolerances, preferably in the order of 0.0005 to 0.0015 inches in adjacent vertical die areas 11 and 12 so as to accurately control axial alignment of the rolled ring. Clearance is designed into adjacent die areas 15, 16, 17, and 18 to accommodate the ring cross-section 8. The upper and lower dies of each set are designed such that they have shoulders 13 and 14 respectively mating at the end of the rolling operation for that die set. This is not required if the rolling mill has adequate closure controls. Because the dies are based on an encapsulating principle, sharp overhang may be used in the area 19, as best seen in FIG. 5 without causing fracture of the dies 9 and 10. Further, while generally the dies 9 and 10 are mated such that the lower die 10 encapsulates the upper die 9, it is also possible with some configurations to avoid breakage due to overhang by encapsulating the upper die 9 with the lower die 10.

The exact shape of the dies utilized for this process will be determined by the desired shape and diameter of the final ring structure and by the following general principles. If the die has a relatively flat rolling surface it will cause a reduction in material thickness and a diametrical increase with minimum axial redistribution of material. Such flat rolling surfaces cause internal circumferential stresses to be set up in the rolled structure unless the amount of reduction is uniform across the axial cross-section of the rolled ring structure. Conversely, if the die face is pointed it will cause a shearing of the ring structure resulting in maximum axial redistribution of material with a minimum diametrical growth and almost no circumferential stresses. Roll bending and roll pinching are two additional methods of axial material redistribution with minimal diametrical growth. The dies utilized for this process are shaped so as to combine these four principles in a manner which will provide for axial distribution of ring material with minimum circumferential stresses.

It will generally be necessary to anneal the ring between die changes since it will have hardened during cold working. The work hardening tendencies of the metal or metal alloy material utilized for the ring will generally determine the amount of reduction in material thickness which may be achieved prior to annealing. It has been found that most nickel and cobalt based alloys can be reduced by cold rolling about 30 percent prior to interstage annealing. However, 40 percent reduction is possible with some alloys and configurations.

When distributing metal axially, it is difficult to equalize the percent reduction along the cross-section. Thus, those portions of the cross-section experiencing the greatest deformation tend to elongate diametrically more than those which experience a lesser reduction. These two areas tend to oppose each other, resulting in compressive and tensile regions within the material. For any material, there is a limit to the amount of such internal stress which can be tolerated prior to interstage anneal. Because of these limitations and those imposed by the general work hardening tendencies of cold worked metal, it is recommended that metallic rings of nickel or cobalt base alloys be annealed after approximately a twenty percent reduction in thickness.

Metal rings rolled in accordance with the methods of this invention may be manufactured to close tolerances without the requirement for any subsequent machining or hot working operations. Tolerance limits of ±0.002 inches have been achieved utilizing the rolling procedure of this invention.

Figure 6:
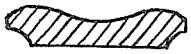
FIG. 6 is a cross-sectional view of the ring of FIG. 3 which has been contoured and enlarged utilizing the method of this invention.
Figure 8:
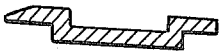
FIG. 8 is a cross-sectional view of the ring of FIG. 7 which has been further processed in accordance with the method of this invention.
Figure 7:
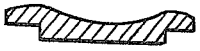
FIG. 7 is a cross-sectional view of the ring of FIG. 6 which has been further contoured and enlarged utilizing the method of this invention.
Figure 10:
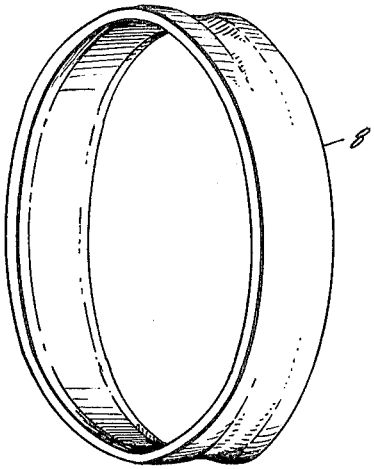
FIG. 10 is a perspective view of the ring of FIG. 6.
Figure 11:
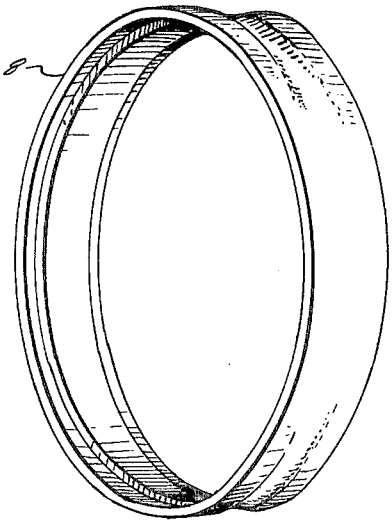
FIG. 11 is a perspective view of the ring of FIG. 7.
Figure 12:
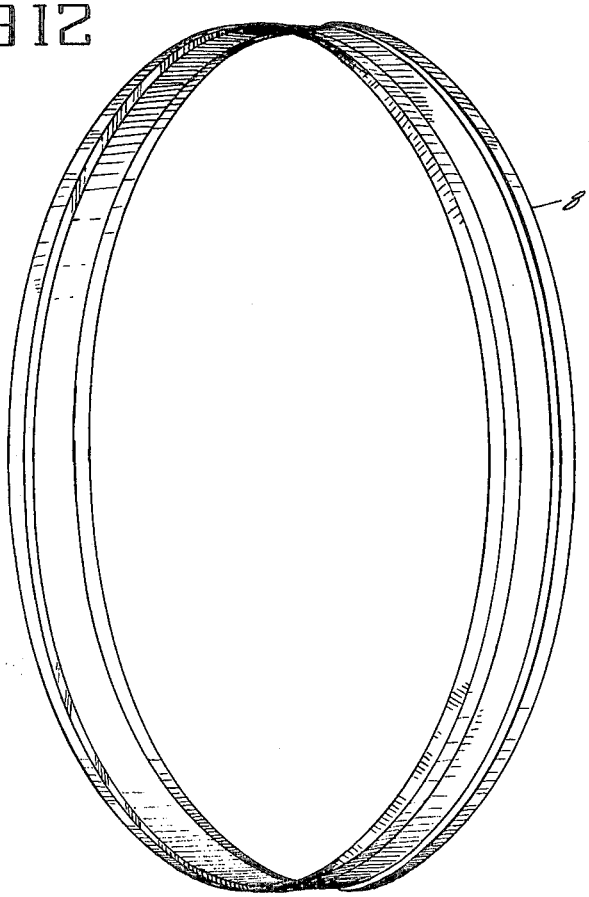
FIG. 12 is a perspective view of the ring of FIG. 8.

By way of example let us consider the construction of a gas turbine engine compressor stator vane ring having the cross-sectional contour as shown in FIG. 8. Such a ring was produced from a starting blank as illustrated in FIG. 3. The blank was initially rolled to the cross-sectional contour illustrated in FIG. 6 utilizing a suitable set of roll dies. This initial rolling operation causes relatively large axial redistribution and contouring of the ring (as can be seen by comparing the initial rectangular cross-section to that of FIG. 6) with approximately 10 percent increase in the diameter of the initial ring blank as illustrated in FIG. 10. After rolling to the cross-sectional contour of FIG. 6 the ring was annealed and then rolled again in a different set of dies to produce a ring having the contour illustrated in FIG. 7 and radial growth in proportion to the cross-sectional decrease of approximately ten percent as ilustrated in FIG. 11. The ring was thereafter subjected to a second annealing and then rolled to the final cross-sectional contour as illustrated in FIG. 8 utilizing a third set of roll dies. This final rolling process results in a ring having a diameter equal to approximately 250 percent of the diameter of the initial starting blank as illustrated in FIG. 12. As can be seen by comparing the ring contours of FIGS. 6 through 8 and the diameter of the rings of FIGS. 10 through 12 the early roll dies are utilized to achieve predominant axial redistribution of ring material while the latter roll dies are utilized to achieve the desired lesser axial material redistribution and radial growth of the desired design requirement. All roll dies were designed so as to completely encapsulate the ring cross-section in the rolling area. When the upper and lower dies for each set were closed rail on rail, the rolling operation for that die set was considered complete. The weight of the starting blank was carefully selected so that when the final pair of roll dies was closed rail on rail, the cross-sectional configuration is controlled to close tolerances. The diameter of rings rolled in this manner are very reproducible so that a subsequent expanding operation of about percent will yield close diametral control (in the illustration shown ±0.002 inches).

While particularly useful in the construction of metal ring structures for gas turbine engines, the method of this invention may be utilized to produce rings for any application requiring contoured ring structures. The method of this invention may be utilized to form metallic rings of a wide variety of cross-sectional contours with cross-sectional thickness variations of 10 to 1 or better and to increase the radial diameters of the starting ring blanks proportionally to meet desired part requirements. Further, while it is preferred that all roll operations be performed cold, it is within the scope of this invention to perform some of the early roll passes hot in order to more rapidly approximate the axial contour early in the rolling operation. It is also possible to use as a starting ring blank for the process of this invention a ring which has been pre-formed by hot rolling or on which other hot working has been done.

Therefore, having described a novel method for the manufacture of metal rings, what is desired to be secured by letters patent of the United States is claimed below.

what is claimed is:

1. A method of manufacturing a metal ring comprising the steps of:

constructing an initial metal ring having a weight substantially equal to the weight of a desired final ring and having a radial diameter substantially less than a desired final radial diameter, successively cold rolling the initial ring between selected pairs of roll dies so as to form the desired contour while concurrently increasing the radial diameter of the ring until a desired final contour and radial diameter are achieved, and wherein the early pairs of roll dies are utilized to produce predominant axial movement of ring material with a lesser increase in the ring diameter so as to approximate the desired final cross-sectional contour in the early stages of rolling and the latter pairs of roll dies are utilized to produce lesser axial movement of ring material and corresponding predominant diametrical increase.

2. The method of claim 1 wherein the initial ring is constructed by rolling length of metal strip stock of simple cross-section into a ring shape and welding the ends of the strip stock to form a ring.

3. The method of claim 1 wherein the initial ring is constructed by back extruding a metal billet to form a cylinder and thereafter slicing the cylinder into rings.

4. The method of claim 1 wherein selected regions of the cross-sectional contour are reduced in thickness in the range of from 1 to 10 times.

5. The method of claim 1 wherein different parts of roll dies are utilized for successive roll operations with intermediate annealing operation between each rolling operation.

6. The method of claim 1 further comprising the step of utilizing a precision expander to expand the diameter of the final rolled ring.

7. The method of claim 1 wherein the ring is successively rolled between selected pairs of roll dies such that the ring cross-section is contoured to a desired shape while the ring diameter is simultaneously increased.

8. The method of claim 7 wherein in each successive roll operation there is both axial movement of ring material and radial enlargement of the ring diameter.

9. The method of claim 1 wherein the initial metal ring is pre-formed by hot rolling.

10. A method of manufacturing a metal ring comprising the steps of:

successively rolling a cold metal ring having a weight equal to the weight of a desired final ring between successive pairs of roll dies so as to contour the cross-section of the ring to a desired shape while simultaneously increasing the diameter of the ring to a diameter substantially greater than the diameter of the initial ring and slightly less than a desired final ring diameter in a manner wherein the early pairs of roll dies are utilized to produce predominant axial movement of ring material with a lesser increase in the ring diameter so as to approximate the desired final cross-sectional contour in the early stages of rolling and the latter pairs of roll dies are utilized to produce lesser axial movement of ring material and corresponding predominant diametrical increase, annealing the ring between successive roll operations as required to permit cold working of ring material without fracture of the ring, and expanding the rolled ring on a precision expander to increase the diameter thereof to a desired final diameter.

11. The method of claim 10 wherein the cross-sectional area of the ring is reduced between the range of 10 percent and thirty percent by each successive die set.

* * * * *